United States Patent [19]

Wood et al.

[11] 4,271,542

[45] Jun. 9, 1981

[54] SWIMMING POOL PLATFORM AND COMPONENTS

[75] Inventors: Charles Wood, Mississauga; Richard Fralick, Bramalea, both of Canada

[73] Assignee: DAF Indal Ltd., Mississauga, Canada

[21] Appl. No.: 3,218

[22] Filed: Jan. 15, 1979

[51] Int. Cl.[3] ..... E04H 3/16; E04H 3/18

[52] U.S. Cl. ..... 4/495; 4/494; 4/506; 4/509; 4/498

[58] Field of Search ..... 4/172, 172.11, 172.12, 4/172.13, 172.14, 495, 494, 498, 506, 509

[56] References Cited

U.S. PATENT DOCUMENTS

| | | | |
|---|---|---|---|
| 2,884,156 | 4/1959 | Graham et al. | 4/172.13 |
| 2,970,320 | 2/1961 | Karp | 4/172.13 |
| 3,086,219 | 4/1963 | Stafford | 4/172.13 |
| 3,091,777 | 6/1963 | Pearlson | 4/172.13 |
| 3,092,844 | 6/1963 | Brunson | 4/172.13 |
| 3,309,716 | 3/1967 | Merritt | 4/172.13 |
| 3,413,661 | 12/1968 | Ross | 4/172.13 |
| 3,670,343 | 6/1972 | Gansloser | 4/172.13 |
| 3,955,797 | 5/1976 | Richards | 4/172.13 X |
| 4,129,905 | 12/1978 | Niamirow | 4/172.13 |

*Primary Examiner*—Henry K. Artis

*Attorney, Agent, or Firm*—Ivor M. Hughes

[57] ABSTRACT

A vertically adjustable pool platform, for use in a swimming pool, means to vertically raise and lower the platform, and means connecting the platform to the means to vertically raise and lower the platform, the pool platform being buoyant to float on the surface of the water, and be constantly urged to float to the surface of the water, when submerged under water at a predetermined level, and the platform permits vertical passage of water therethrough.

43 Claims, 10 Drawing Figures

FIG. 4.
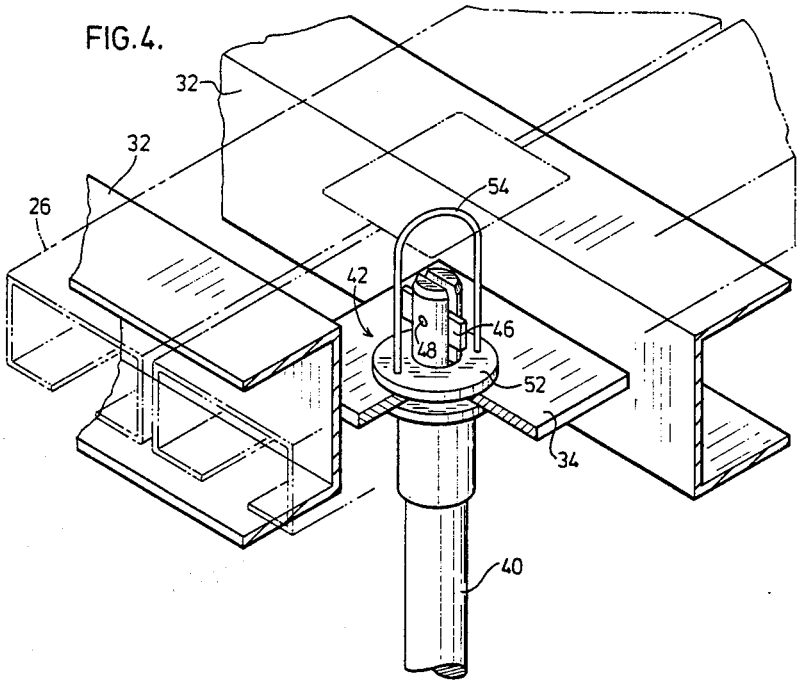
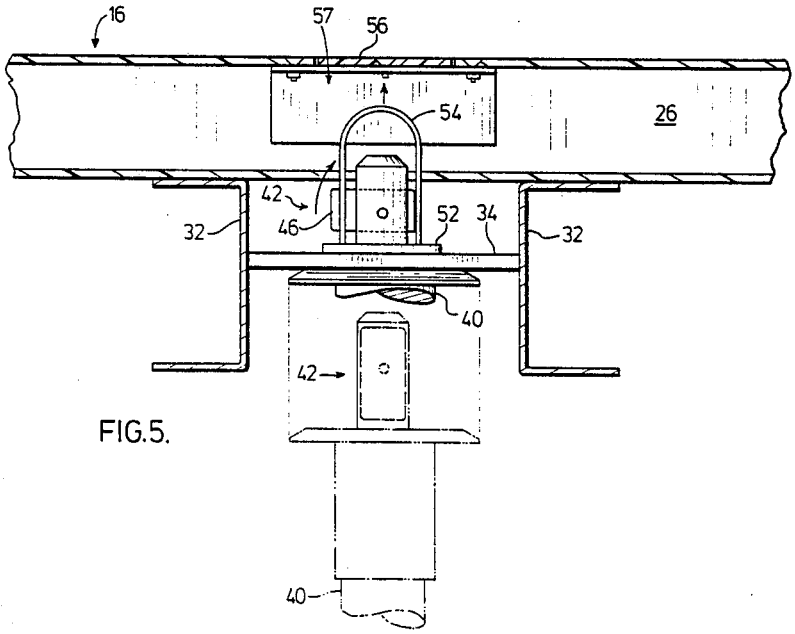
FIG. 5.

SWIMMING POOL PLATFORM AND COMPONENTS

FIELD OF INVENTION

This invention relates to swimming pools and particularly to, swimming pool platforms capable of vertical adjustment, in the pool and, components therefor.

BACKGROUND OF THE INVENTION

Cities holding, for example, international swimming meets require facilities housing olympic size swimming pools of a minimum depth to exceed 6'6". In preparing the meet, the City Councils are each faced with a dilemma. Once the competition is over—then what? The pool would in effect be restricted to swimmers; children, non-swimmers and those who enjoy mixing swimming with small talk, while wading, would effectively be barred the pool's use. The addition of a wading pool would only add to the cost, and complicate the construction of the facilities.

A suggested response to the dilemma has been the variable pool platform, variable from a position adjacent the bottom of the pool to a position permitting wading. However, none of the structures proposed to date have provided the safety and reliability desired.

For example, U.S. Pat. No. 3,052,893 proposes a pool platform secured for adjustment on threaded rods on either side of the pool for changing the depth of the pool. However, such proposal is impractical and unsafe. Levelling the platform would be difficult and in time with the wearing of the coupling of the platform to the threaded rods, the platform becomes less reliable. At that time, the safety would be questionable and a person cleaning under the platform could be killed if the platform should slide down the rods. For similar reasons, the structure shown in U.S. Pat. No. 3,435,465 is both impractical and unsafe. While levelling the structure shown in U.S. Pat. No. 3,935,600 would not be an insurmountable problem, it suffers the other deficiencies discussed above.

It is therefore, an object of this invention to provide a pool platform and components therefor, which overcome the aforementioned difficulties with the prior art.

It is a further object of this invention to provide a pool platform (and components therefor) that is safe, easy to use, and permits easy access for cleaning and maintenance with complete safety.

Further and other objects of the invention will be realized by those skilled in the art from the following summary of the invention and detailed description of the preferred embodiments thereof.

SUMMARY OF THE INVENTION

According to one aspect of the invention, a rigid and bouyant pool platform capable of supporting people standing thereon is provided which floats in the water so that when submerged under water at a pre-determined level, it is constantly uged to the surface, and also permits water passage vertically therethrough.

In this regard, and according to another aspect of the invention, spaced buoyant members may be secured on the top of the platform. Preferably, each member in cross-section is pultruded into an inverted U-shape channel preferably with inwardly directed lips at the end of each U-Arm, for providing a space for holding buoyant materials therein, for example, air bags, air chambers, foam material having non-communicating gas cells, etc. and, for securing each member (which may be a thin slat) to the platform;

According to another aspect of the invention, a plurality of members or slats forming the upper surface of the platform may be secured to two sets of spaced parallel beams, the sets of beams being joined by cross members including apertures therethrough.

According to another aspect of the invention, the pool platform may be supported for vertical movement elevating and lowering on double acting four hydraulic cylinders, the cylinders being secured to the platform by piston rods preferably having piston rod end assemblies secured to the platform through the apertures in the cross members, the piston rod assemblies preferably having swivel bars, each bar rotatable from a vertical position to a horizontal position and being of a length between its center of rotation and its free end greater than half of the maximum cross-wise dimension of the aperture. In use the swivel bars are each inserted through the aperture in each cross member and rotated from its vertical disposition to a horizontal disposition, to secure the cross members and thus the platform to the hydraulic cylinders. Preferably, the bar is rotated through an angle greater than 90°.

Access to the cross member from the top of the platform may be provided by cutting an opening in the members or slats overlying the aperture and providing a cover to lie flush with the surface of the platform to close the opening. A ring washer may be inserted over each rod assembly after the bar is inserted through the aperture but prior to rotating the bar to its horizontal locking disposition, the ring washer being of greater cross-wise dimension than the aperture to assist in the locking of the platform to the cylinder.

Also, preferably, a handle is secured to the washer for easy retrievel and insertion.

According to another aspect of the invention, the pool platform may be supported for vertical movement on double acting hydraulic cylinders having matching pumps, one matching pump per hydraulic cylinder, which when operated simultaneously, to provide substantially level elevation and lowering of the pool platform. Preferably, the cylinders each have a piston of sufficient length to permit the platform to be elevated above the water surface of the pool. Preferably, the platform is buoyant. In this event, when the pumps are operated to raise the platform, the platform may have a tendancy to drift upwardly making level elevation less precise. To overcome this problem, according to another aspect of the invention, a restriction in the cross-wise dimensions of the circuit lines returning fluid from the cylinders is provided to ensure the pump works effectively, and efficiently, when the platform is raised.

In one embodiment, the restriction is provided in the circuitry between the hydraulic cylinders and pumps in parallel to a one way check valve, so that fluid pumped in the direction away from the pump to the cylinder to cause the cylinder to lower the platform passes through the check valve and fluid returned from the cylinders when raising the platform, passes through the restriction.

Since the platform in most cases will not extend the full length of the pool, a vertical barrier, according to another aspect of the invention, is provided at the outer end of the platform to preclude any persons stepping from the pool platform into the deep end of the pool, or to preclude any person swimming in the deep end to swim under the platform, the barrier comprising netting permitting the flow of water therethrough and extending upwardly from the bottom of the pool whereat it is secured, to preferably float on the water's surface. In some instances, where swimming directly from the platform into the deep end is desired, the barrier extends from the platform to the bottom of the pool.

Preferably when the barrier extends from the water's surface to the pool bottom, the barrier is maintained adjacent the outer edge of the platform in a thin slot provided between an outrigger member (beam) secured to extend across the pool platform and the platform the barrier in cooperating with the slot to preclude bodily members being caught between the barrier and platform.

According to another aspect of the invention, the barrier when not in use, may be stored by the use of a take-up mechanism for drawing the barrier under the pool platform. In one embodiment, the take-up mechanism includes a take-up body, on the side of the barrier remote from the platform, and having both its ends secured to a cable, the cable passing over pulleys for drawing the cable under the platform and thus the take-up body to a position under the platform.

As a result, in combination, a safe, easily maintained and reliably operated pool platform and components therefor, are provided. When cleaning under the platform, is required, the operator has two options, the first being the raising of the platform above the water surface to allow use of common hand operated pool vacuum equipment. The second option is to raise the platform to the water surface, disengage the platform, lower the elevating mechanism and floating the free platform to another location in the pool, fully exposing the pool area normally covered by the platform. In either event, the operator need not fear the collapse of a cement, or heavier than water, pool platform on him, or even enter the water. Additionally, where the pool platform does not extend the length of the pool, the barrier protects any child playing on the platform from stepping into the deep end, or allowing deep end swimmers to swim under the platform.

BRIEF DESCRIPTION OF THE DRAWINGS

The invention will now be illustrated having regard to the drawings illustrating preferred embodiments of the invention.

FIGS. 4 and 5 are close up, partly cut away views of part of the pool platform shown in FIG. 3 and particularly, the preferred method of securing the platform to the hydraulic system;

DETAILED DESCRIPTION OF THE PREFERRED EMBODIMENTS

Figure 1:
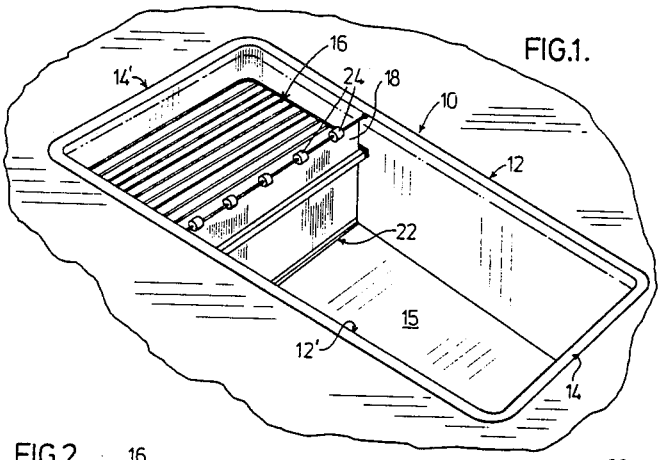
FIG. 1 is a perspective view looking downwardly on the swimming pool incorporating a pool platform and components thereof, according to the preferred embodiments of the invention.
Figure 2:
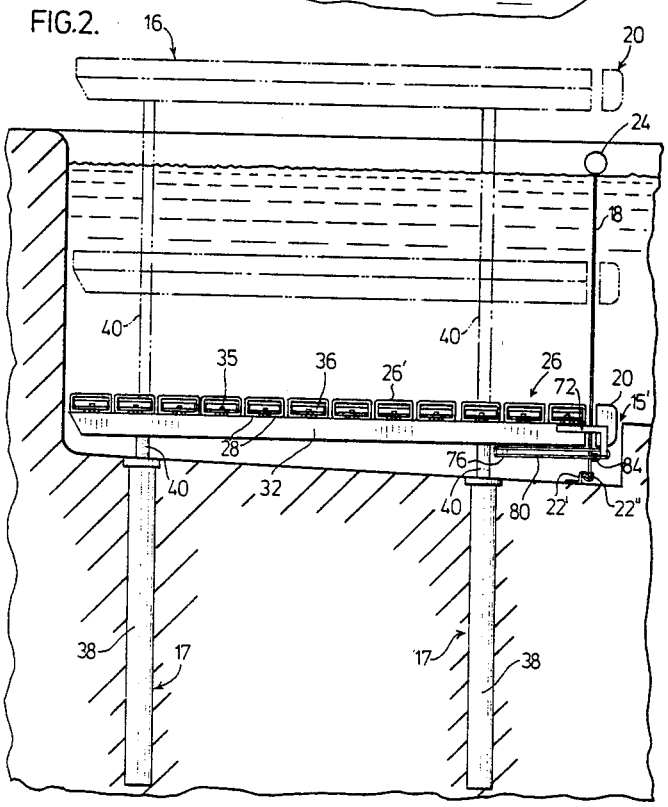
FIG. 2 is a schematic side view of the pool platform of FIG. 1 in various positions relative to the bottom of the pool floor.
Figure 9:
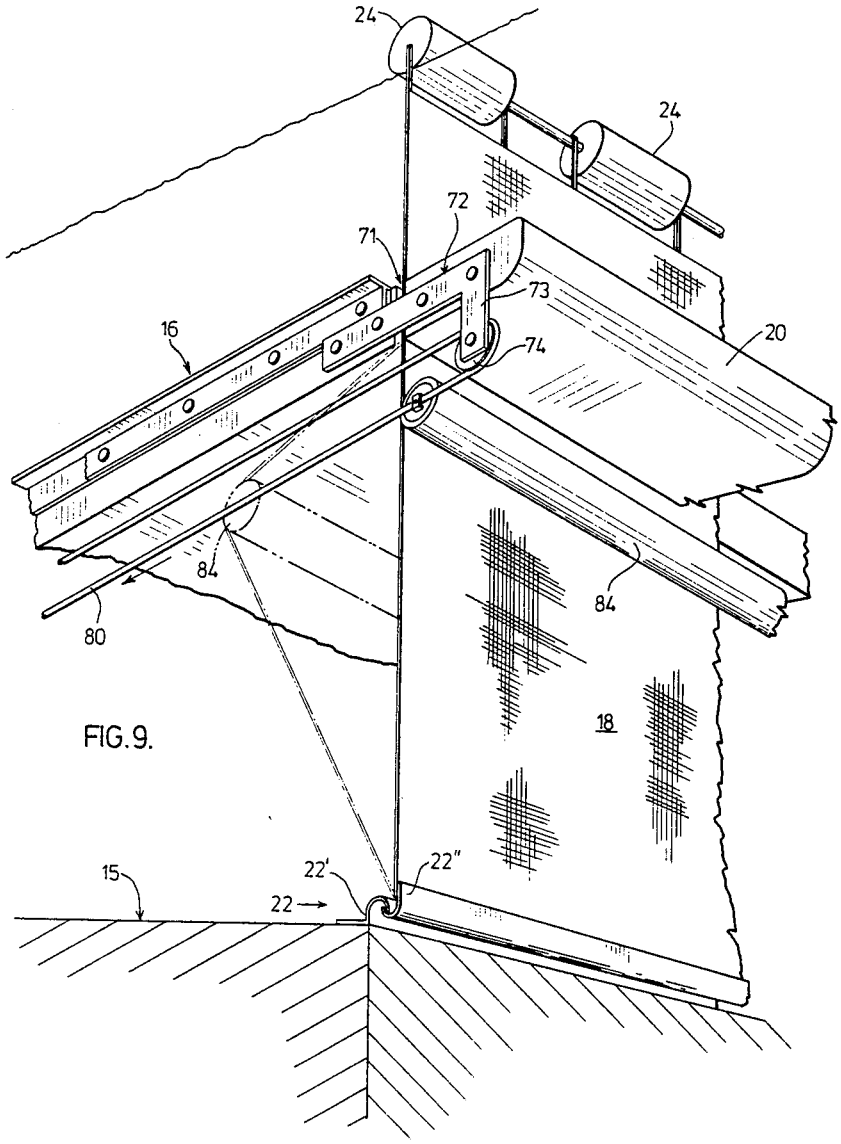
FIG. 9 is a close-up view of part of the barrier according to the preferred embodiments of the invention.
Figure 10:
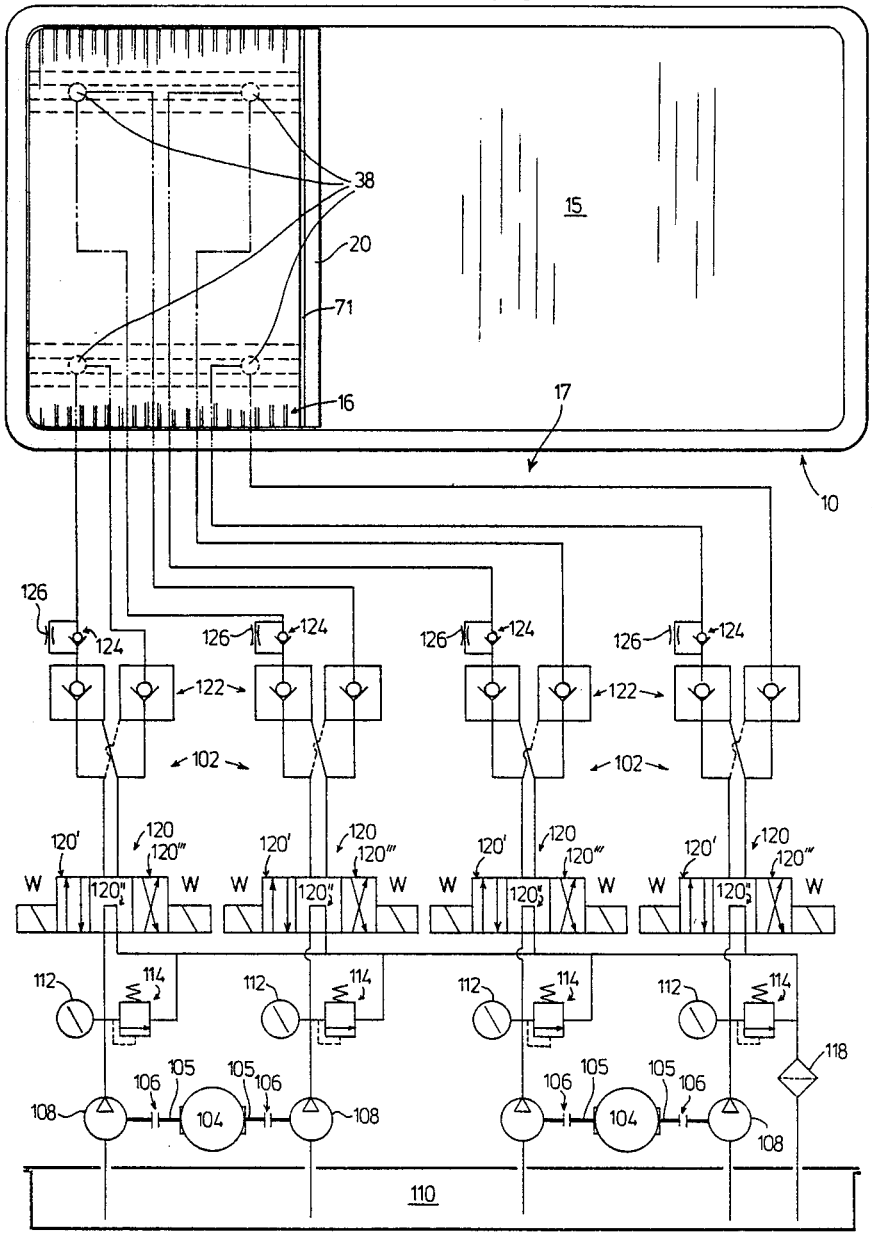
FIG. 10 is a schematic of hydraulic circuitry used to elevate and lower the platform according to the preferred embodiments of the invention.

With reference to the drawings, and initially FIG. 1, there is shown rectangular swimming pool 10, having poured concrete side walls 12, and 12$^1$, end concrete walls 14 and 14$^1$ and bottom 15, sloped downwardly from end 14$^1$ to end 14, and having recess 15$^1$ adjacent end 14$^1$ of a length to house variable platform 16 adjustable from a position adjacent recess 15$^1$ to a position raised above pool 10 and any position therebetween (See FIG. 2) by hydraulic lifting equipment 17, partially shown in FIGS. 2, 4, 5 and schematically in circuit diagram shown in FIG. 10. Platform 16 is separated from the rest of the pool by barrier 18 disposed between outrigger guard slat 20 as will be described in more detail hereafter, secured to the end of the platform remote end wall 14$^1$, barrier 18 extending from the bottom of the pool whereat it is secured at 22 by reverse hooks 22$^1$ and 22$^{11}$ extending across the width of pool 10, (See FIG. 9) to the top of the water where it is floated by floats 24.

Figure 3:
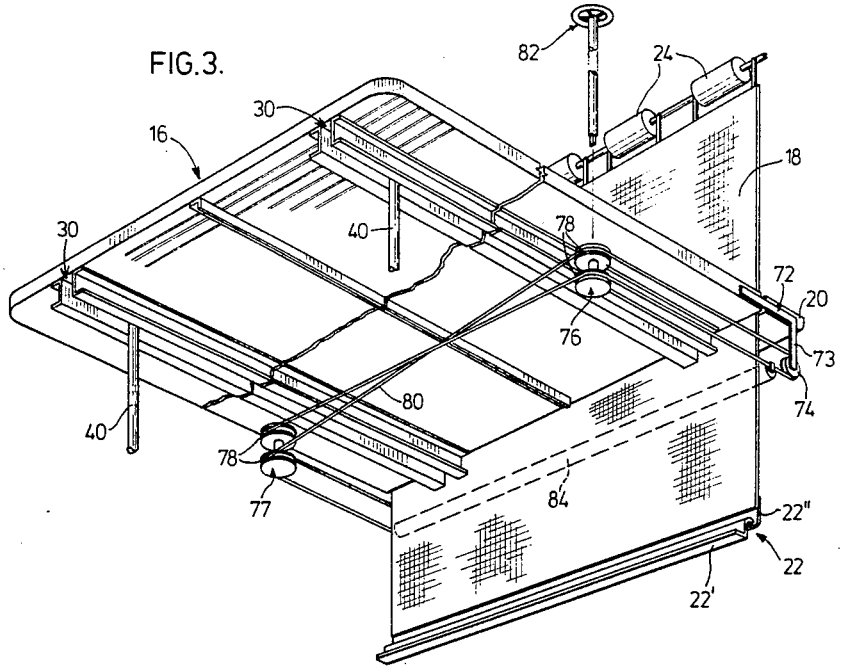
FIG. 3 is a perspective view of the platform looking upwardly from underneath the pool platform shown in FIGS. 1 and 2.
Figures 6, 8:
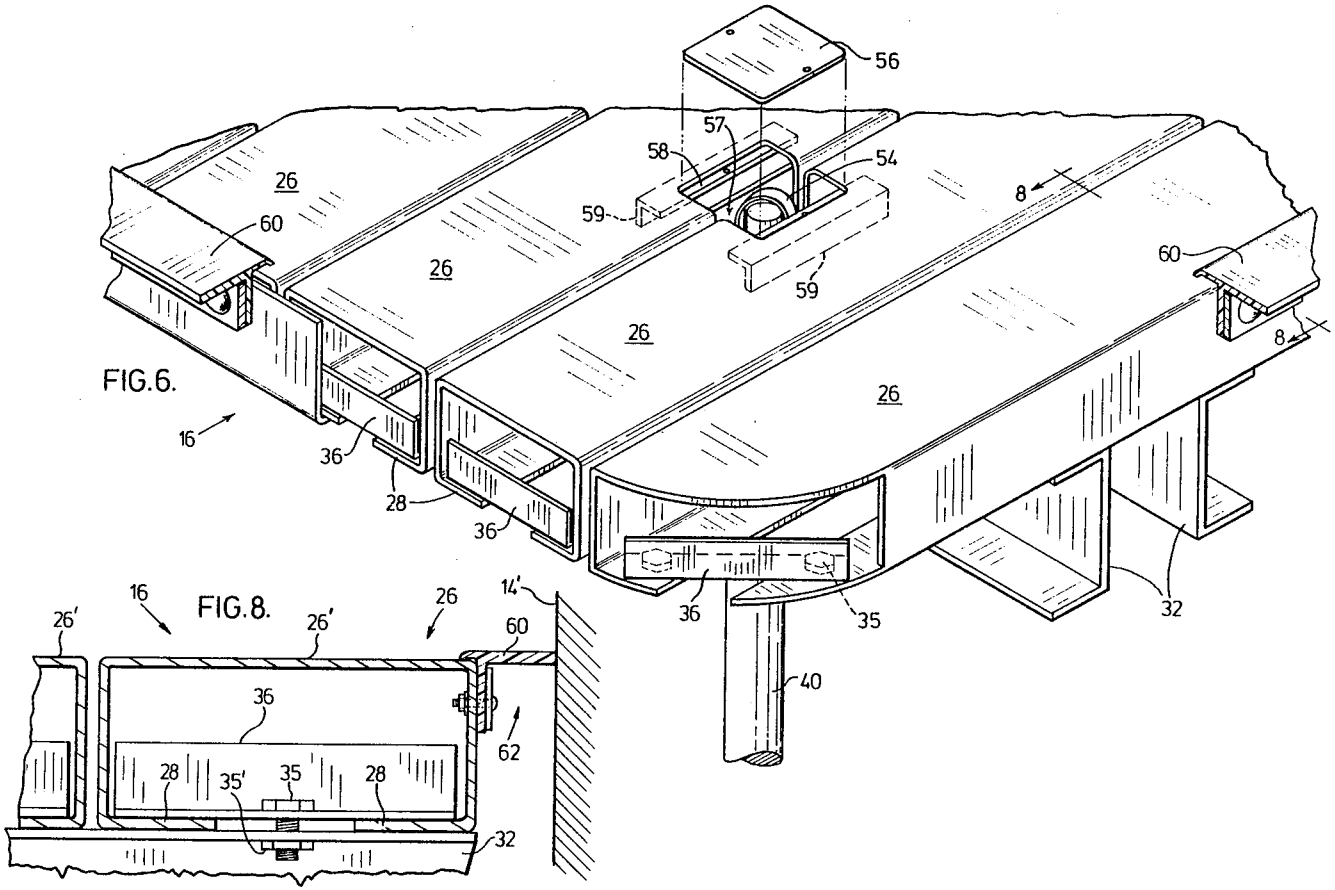
FIG. 6 is a close-up perspective view looking angularly downwardly on a corner of the pool platform shown in FIG. 3.
FIG. 8 is a cross-sectional view taken along the line 8—8 of FIG. 6.

With reference to FIGS. 2, and 8, pool platform 16 is shown to consist of pultruded inverted U-shaped slats 26, having a flat top 26$^1$ and inwardly directed lips 28 in cross-section (see also FIG. 8) and being secured to two sets 30 of parallel laterally opening U-channel beams 32, seen best in FIG. 3, beams 32 being joined, by cross-beams 34 (see FIGS. 4 and 5) by bolts 35 (seen best in FIG. 8) and nuts 35$^1$ extending through apertures (not shown) in the upper surface of beams 32, and, swivel bars 36 (shown in FIGS. 2 and 8), which swivel from a position in alignment with the space between lips 28 to extend across lips 28 to secure the slats 26 to beams 32.

Platform 16 is elevated using hydraulical lifting equipment 17, having four identical double acting hydraulic cylinders 38, each of cylinders 38 being buried in the concrete of bottom 15 of the pool floor and having piston rods 40 extending upwardly therefrom and secured to the platform 16 by piston rod end assemblies 42, in the manner shown in FIGS. 4, 5 and 6. As can be seen, each piston rod end assembly 42, extends through an aperture (not shown) in cross-beam 34 in alignment with piston rod 40 and cross-beam 34 is locked thereto by swivel bar 46, swivelled on pin 48 in slot 50 cut in the top of piston rod assembly 42 to a horizontal locking disposition (shown in FIGS. 4 and 5) overlying washer 52 and that part of cross-beam 34 adjacent the aperture. For removal, washer 52 is lifted by handle 54, swivel bar 46 oriented vertically (see FIG. 5) and piston 40 retracted. To facilitate removal or attachment of piston rod end assembly 42 from cross-beams 34, (seen best in FIG. 6) cover plate 56 is provided to close opening 57 cut in slat 26, directly over piston rod end assembly 42 by seating on ledges 58 formed by angle irons 59 (see FIG. 6) secured to slats 26 on either side to extend into opening 57 to support cover plate 56 flush with the upper surface of slats 26.

Platform 16 has at its periphery adjacent walls 12, 12$^1$ and 14$^1$, protective edge guard leg portion 60 (see FIGS. 6 and 8) to prevent toes and fingers being lodged in for example, space 62 between wall 14[1] and platform 16.

Figure 7:
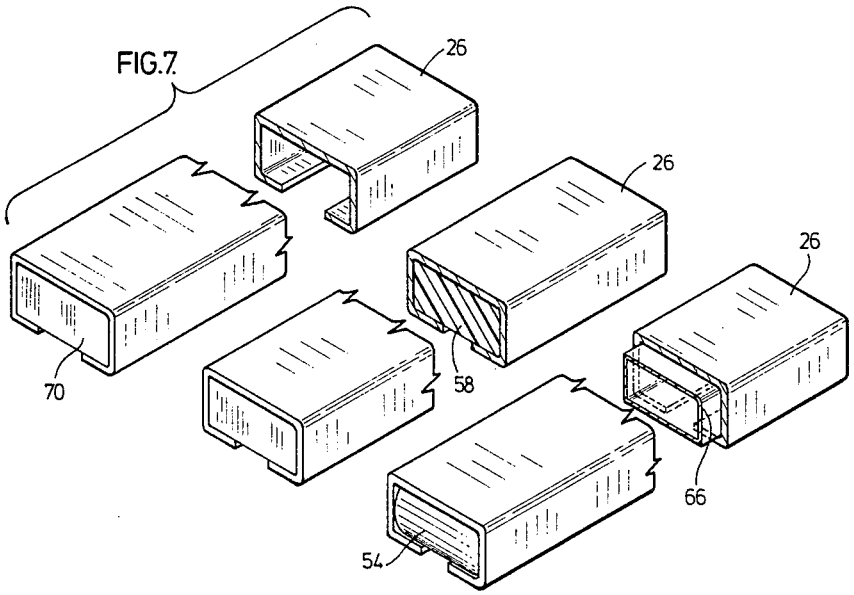
FIG. 7 (found with FIG. 3) illustrates the construction of various slats forming part of the pool platform according to the preferred embodiments of the invention.

With reference to FIG. 7, slats 26 having various buoyancy aids are provided-for example, plastic air bags 54, rectangular buoyant tubular member 66, styrofoam block 58, and hollow float block 70.

Barrier 18 comprising a netting is provided to extend from the bottom of pool 15 to which it is secured by hooks 22[1] and 22[11] upwardly through slot 71 formed between platform 16 and outrigger slat 20 secured at either end by elbow 72 to platform 16, to floats 24 on the water. Secured to each of portions 73 of elbows 72 is pulley 74 for the purposes hereinafter described. With reference to FIG. 3, pulleys 76 and 77 are provided under platform 16, spaced from outrigger slat 20, each pulley 76 and 77 having cable runner channels 78 at the top and bottom thereof. Cable 80 is secured over pulley 76, into lower channel 78 of pulley 76 then to upper channel 78 of pulley 77 then over a pulley on the other side of the platform (not shown) back to lower channel 78 of pulley 77 then to upper channel 78 of pulley 76, then back to pulley 74. Keyed turning wheel 82 is provided to key into an aperture (not shown) in assembly 76 for turning pulley 76. Take-up body 84 extending across barrier 18 on the side of barrier 18 remote platform 16 is secured to cable 80 (See FIG. 9). When the pool platform 16 is to be taken to the bottom, the barrier can be left as is (see FIG. 2) be unhooked and detached from float buoys 24 and removed completely or be drawn inwardly along cable 80 by turning pulley 76 with keyed turning wheel 82, thus turning the other pulleys drawing take-up body 84, inwardly, pushing barrier 18 under the platform.

Pool platform 16 is lowered and raised at level attitude by hydraulic equipment 17, shown in part in FIG. 2 and through circuits 102 and the accompanying equipment shown schematically in FIG. 10.

With reference thereto, two Dowty, One Horsepower, 1800 R.P.M. 230/440 V. 3PH, 60 Hz. Dripproof Electric Motors 104, having double extended shafts 105 are coupled by couplings 106 to four matching OP 3003 gear pumps 108, matched to supply equal flows of fluid from common reservoir 110 to circuitry 102. Pressure in circuitry 102 is, monitored by pressure gauges 112 and relieved by modular relief valve 114 set to 1000 psi for return to reservoir 110 along return line 116 through return line filter 118. Fluid pumped by pumps 108 is fed through self centering, three position, four way solenoid operated directional control valves 120 then modular pilot operated check valve 122 (which prevent slippage of the piston, not shown) of hydraulic cylinders 38 through check valve 124 secured in parallel with restricted orifice 126 (operational only in the direction of fluid flow from the hydraulic cylinder 38 to modular valves 122).

For the lowering of each piston rod 40 of each of cylinders 38, for the lowering of the platform at a level attitude, pumps 108 are engaged and operated simultaneously by motors 104 for equal supply of fluid in circuits 102 to directional control valves 120 to provide fluid through control valve lines 120[1] aligned by activation of the solenoid in circuitry 102 to direct fluid to modular check valves 122 to permit fluid to be passed through check valves 124 to cylinders 38 and returned to reservoir 110 along return line 116.

When the platform is maintained stationary, line portion 120[11] is positioned in the circuitry 102. Because of the buoyance of platform 16, the piston may tend to leak, therefore, special Miller cylinders with teflon seals for lower pressure are employed. When raising cylinders 38, lines 120[111] and orifice 126 come into play. Because of the light loads on the pistons and piston rods of cylinders 38 (because of the buoyancy of platform 16 in the water), the tendency for the pump to slip, at a generally reduced pressure, upsets the desired fixed flow rate of fluid through the circuitry. Consequently, this tendency is counteracted by passing fluid through orifice 126 in a direction away from cylinders 38 which causes the pumps 108 to work at normal pressure, i.e. the same as that pressure when lowering the platform.

As many changes could be made to the scope of the invention without departing from the scope thereof, it is intended that all matter contained herein be interpreted as illustrative thereof, and not in a limiting sense.

The embodiments of the invention in which an exclusive property of privilege is claimed are as follows:

1. For use in a swimming pool containing water, a vertically adjustable pool platform, means to vertically raise and means to vertically lower said platform, and means connecting the pool platform to the means to vertically raise and means to vertically lower, said platform, said pool platform being rigid, buoyant and having openings therethrough so as to float on the surface of the water, and so as to be constantly urged to float to the surface when submerged under water at a predetermined level and which platform is capable of supporting people standing therein when secured for use and permits the vertical passage of water therethrough.

2. The combination of claim 1, wherein said means to vertically raise and means to vertically lower said platform comprises double acting hydraulic cylinders having piston rods extending therefrom and connected to the pool platform and hydraulic circuitry for the operation of the hydraulic cylinders, the hydraulic cylinders being connected to matching pumps to provide a uniform equal flow rate of hydraulic fluid to and from each cylinder for simultaneous operation for the level elevation of the pool platform.

3. The combination of claim 1, further including a barrier extending from the pool platform to the bottom of the pool, the barrier comprising netting to permit the flow of water therethrough.

4. The combination of claim 1, further including a barrier extending upwardly from the bottom of the pool adjacent the pool platform to preclude, swimmers from swimming under the platform, and waders from moving from the shallow water to the deeper water and bodily members being caught between the barriers and platform, the barrier comprising netting to permit the flow of water therethrough.

5. The combination of claim 1, further including a barrier extending upwardly from the bottom of the pool, to the surface of the water, through a thin slot, created between the pool platform and an outrigger member secured to the pool platform adjacent any pool platform edge adjacent the open deeper water, the barrier in cooperating with the slot to preclude, swimmers from swimming under the platform, waders from moving from the shallow water to the deeper water, and bodily members being caught between the barrier and platform, the barrier comprising netting to permit the flow of water therethrough.

6. The combination of claim 1 wherein the platform comprises spaced buoyant members.

7. The combination of claim 6 wherein spaced buoyant members contain a buoyant material.

8. The combination of claim 7 wherein the buoyant material comprises an air bag, air chamber, or foam material having non-communicating gas cells, and the members have been pultruded.

9. The combination of claim 6, wherein, the plurality of members are secured to two sets of spaced parallel beams, the beams being joined by cross members.

10. The combination of claim 9, wherein the cross members have apertures therethrough and the means to vertically raise and lower said platform are four hydraulic cylinders having rod assemblies on the end of piston rods, the rod assemblies being secured to the platform through the apertures through the cross members, the rod assemblies having swivel bars, each bar rotatable from a vertical position to a horizontal position and being of a length between its center of rotation and its free end greater than half the maximum cross-wise dimension of the aperture.

11. The combinations of claim 10, wherein a ring washer is inserted over each rod assembly after the bar is inserted through the aperture, but prior to rotating the bar to its horizontal locking disposition, the ring washer being of greater cross-wise dimension than the aperture, to assist in the locking of the platform to the cylinder.

12. The combination of claim 2 wherein the piston of the hydraulic cylinders are of sufficient length to permit the platform to be elevated above the upper level of the water surface.

13. The combination of claim 2 wherein a restriction and one way check valve are provided in parallel, in the hydraulic circuitry between the hydraulic cylinders and the pumps so that fluid pumped in the direction away from the pump to the cylinder to cause the cylinder to lower the platform pases through the check valve and fluid pumped away from the pump to the cylinder to cause the cylinder to raise the platform passes through the restriction.

14. For use in a swimming pool containing water, a vertically adjustable pool platform, means to vertically raise and means to vertically lower said platform, means connecting the pool platform to the means to vertically raise and means to vertically lower said platform and a vertical barrier extending upwardly from the bottom of the pool, to the surface of the water, through a thin slot, created between the pool platform and an outrigger member secured to the pool platform adjacent the open deeper water, the barrier in cooperating with the slot to preclude swimmers from swimming under the platform, waders from moving from the shallow water to the deeper water, and bodily members being caught between the barrier and platform, the barrier comprising netting to permit the flow of water therethrough.

15. The combination of claim 14, wherein the platform is rigid and buoyant so as to float on the surface of the water, and so as to be constantly urged to float to the surface of the water when submerged under water at a predetermined level and permit water to pass therethrough.

16. The combination of claim 15 wherein the platform comprises spaced buoyant members.

17. The combination of claim 16 wherein spaced buoyant members contain a buoyant material therein.

18. The combination of claim 17 wherein the buoyant material comprises an air bag, air chamber or foam material having non-communicating gas cells, and the members have been pultruded.

19. The combination of claim 16, wherein the plurality of members are secured to two sets of spaced parallel beams, the sets of beams being joined by cross members.

20. The combination of claim 19 wherein the cross members have apertures therethrough and the means to vertically raise and lower said platform are four hydraulic cylinders having rod assemblies on the end of piston rods, the piston rod assemblies being secured to the platform through the apertures through the cross members, the rod assemblies having swivel bars, each bar rotatable from a vertical position to a horizontal position and being of a length between its center of rotation and its free end, greater than half the maximum cross-wise dimension of the aperture.

21. The combination of claim 19 wherein a ring washer is inserted over each rod assembly after the bar is inserted through the aperture, but prior to rotating the bar to its horizontal locking disposition, the ring washer being of greater cross-wise dimension than the aperture to assist in the locking of the platform to the cylinder.

22. The combination of claim 15, wherein said means to vertically raise and means to vertically lower said platform comprises double acting hydraulic Cylinders having piston rods extending therefrom and connected to the pool platform, and hydraulic circuitry for operating the hydraulic cylinders, the hydraulic cylinders being connected to matching pumps for simultaneous operation for the level elevation of the pool platform.

23. The combination of claim 22 wherein the pistons of the hydraulic cylinders are of sufficient length to permit the platform to be elevated above the upper level of the water surface.

24. The combination of claim 22 wherein a restriction and one way check valve are provided in parallel, in the hydraulic circuitry between the hydraulic cylinders and the pumps, so that fluid pumped in the direction away from the pump to the cylinder to cause the cylinder to lower the platform, passes through the check valve, and fluid pumped away from the pump to the cylinder to cause the cylinder to raise the platform, passes through the restriction.

25. For use in a swimming pool containing water, a vertically adjustable rigid and buoyant platform so as to float on the surface of the water, and so as to be constantly urged to float to the surface of the water when submerged under water at a predetermined level and being capable of supporting people standing therein when secured for use, and which platform permits the vertical passage of water therethrough, double acting hydraulic cylinders having piston rods extending therefrom connected to the pool platform, hydraulic circuitry for operating the hydraulic cylinders and having matched pumps, the hydraulic cylinders being connected to the matched pumps, one hydraulic cylinder being connected to each matched pump for the simultaneous operation thereof to ensure a uniform equal flowrate of hydraulic fluid to and from each cylinder by its connected pump during the raising or lowering of the piston rods for the level elevation and lowering of the pool platform, and means on the piston rods for connecting the pool platform to the hydraulic cylinders.

26. The combination of claim 25, further comprising a vertical barrier extending upwardly from the bottom of the pool, to the surface of the water, adjacent any end of the pool platform adjacent the open deep water of the pool and permitting the passage of water therethrough.

27. The combination of claim 26, wherein the barrier comprises netting and passes through a thin slot between the pool platform and an outrigger member adjacent said pool platform end, the barrier co-operating with the slot to preclude bodily members being caught between the barrier and platform.

28. The combination of claim 26, wherein the platform comprises spaced buoyant members.

29. The combination of claim 28 wherein each member contains a buoyant material.

30. The combination of claim 29 wherein the buoyant material comprises an air bag, air chamber or foam material having non-communicating gas cells and the members have been pultruded.

31. The combination of claim 28 wherein the plurality of members are secured to two sets of spaced parallel beams, the sets of beams being joined by cross members.

32. The combination of claim 31, wherein the cross members have apertures therethrough and the means on the piston rods comprises rod assemblies on the end of the piston rods, the rod assemblies being secured to the platform through the apertures through the cross members, the rod assemblies having swivel bars, each bar rotatable from a vertical position to a horizontal position and being of a length between its center of rotation and its free end greater than half the maximum cross-wise dimension of the aperture.

33. The combination of claim 32 wherein a ring washer is inserted over each rod assembly after the bar is inserted through the aperture, but prior to rotating the bar to its horizontal locking disposition, the ring washer being of greater diameter than the aperture to assist in the locking of the platform to the cylinder.

34. The combination of claim 25 wherein the pistons of the hydraulic cylinders are of sufficient length to permit the platform to be elevated above the upper level of the water surface.

35. The combination of claim 25 wherein a restriction and one way check valve are provided in parallel, in the hydraulic circuitry between the hydraulic cylinders and the pumps so that fluid pumped in the direction away from the pump to the cylinder to cause the cylinder to lower the platform passes through the check valve and fluid pumped away from the pump to the cylinder to cause the cylinder to raise the platform, passes through the restriction.

36. The combination of claim 2, wherein the platform comprises spaced buoyant members.

37. The combination of claim 36, wherein the spaced buoyant members contain a buoyant material.

38. The combination of claim 37, wherein the buoyant material comprises an air bag, air chamber, or foam material having non-communicating cells, and the members have been pultruded.

39. The combination of claim 36, wherein the plurality of members are secured to two sets of spaced parallel beams, the beams being joined by cross members.

40. The combination of claim 39, wherein the cross members have apertures therethrough, and the means to vertically raise and lower said platform are four hydraulic cylinders having rod assemblies on the end of piston rods, the rod assemblies being secured to the platform through the apertures through the cross members, the rod assemblies having swivel bars, each bar rotatable from a vertical positon to a horizontal position and being of a length between its center of rotation and its free end greater than half the maximum cross-wise dimension of the aperture.

41. The combination of claim 40, wherein, a ring washer is inserted over each rod assembly after the bar is inserted through the aperture, but prior to rotating the bar to its horizontal locking disposition, the ring washer being of greater cross-wise dimension than the aperture, to assist in the locking of the platform to the cylinder.

42. For use in a swimming pool containing water, a vertically adjustable rigid platform being capable of supporting people standing thereon when secured for use, hydraulic cylinders having piston rods extending therefrom connected to the pool platform, hydraulic circuitry having matched pumps for operating the hydraulic cylinders, one hydraulic cylinder being connected to each matched pump for the simultaneous operation of the matched pumps to ensure a uniform equal flowrate of hydraulic fluid to and from each cylinder by its connected pump during the raising and lowering of the piston rods for the level elevation and lowering of the pool platform, and means on the piston rods for connecting the pool platform to the hydraulic cylinders.

43. The combination of claim 42, wherein the hydraulic cylinders are double acting hydraulic cylinders.

* * * * *